US006267655B1

(12) United States Patent
Weldon et al.

(10) Patent No.: US 6,267,655 B1
(45) **Date of Patent: *Jul. 31, 2001**

(54) RETAINING RING FOR WAFER POLISHING

(75) Inventors: David E. Weldon, Santa Clara; Shu-Hsin Kao, Redwood City; Michael Leach, Stockton; Charles J. Regan, Moraga; Linh X. Can, San Jose, all of CA (US)

(73) Assignee: Mosel Vitelic, Inc., Hsinchu (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/116,311

(22) Filed: Jul. 15, 1998

(51) Int. Cl.[7] ..... B24B 7/22
(52) U.S. Cl. ..... 451/307; 451/398
(58) Field of Search ..... 451/288, 287, 451/41, 398, 296, 307

(56) References Cited

U.S. PATENT DOCUMENTS 3,860,399 * 1/1975 Noble et al. ..... 451/41
5,398,459 * 3/1995 Okumura et al. ..... 451/41
5,664,988 * 9/1997 Stroupe et al. ..... 451/288
5,722,877 * 3/1998 Meyer et al. ..... 451/307
5,967,885 * 10/1999 Crevasse et al. ..... 451/364

* cited by examiner

*Primary Examiner*—Robert A. Rose
(74) *Attorney, Agent, or Firm*—Skjerven Morrill MacPherson LLP; Edward C. Kwok; Daniel P. Stewart

(57) ABSTRACT

An improved wafer polishing machine is disclosed. In one embodiment, the wafer polishing machine has a movable polishing surface and a holder that holds an object, such as a semiconductor wafer, against the movable polishing surface. The holder includes a support structure that supports the object in contact with the polishing surface and an annular retaining ring that retains the object in alignment with the support structure. The retaining ring has a plurality of projections projecting inwardly from its inner circumference. The projections are evenly spaced around the inner circumference of the retaining ring. In one embodiment, the projections on the retaining ring define a circle with a diameter no less than the diameter of the object being polished. In an alternative embodiment, the retaining ring has a smooth, circular inner circumference formed from a flexible material which distends to from a continuous arc of contact with the wafer during polishing. Each retaining ring disclosed herein forms multiple points of contact or a continuous arc of contact between the retaining ring and the wafer, thereby reducing wafer buckling during polishing and improving surface uniformity.

18 Claims, 4 Drawing Sheets

RETAINING RING FOR WAFER POLISHING

TECHNICAL FIELD OF THE INVENTION

The present invention relates to semiconductor wafer processing, and in particular to a retaining ring of a wafer holder for wafer polishing.

BACKGROUND OF THE INVENTION

In polishing applications such as chemical mechanical polishing, measures are taken to ensure that the surface being polished is subjected to uniform, isotropic polishing forces. The uniformity of the polishing force applied to the surface is a significant factor in determining the degree of surface uniformity that can be attained through polishing.

Thus, for example, in a chemical mechanical polishing machine with continuous belt polishing, the longitudinal motion of the belt is often supplemented by lateral and rotational motion of the wafer to ensure that every area of the wafer is subjected to uniform, isotropic polishing forces.

The force generated by friction between the wafer and the belt will, at any given instant, be exerted primarily in the direction of the belt movement across the surface of the wafer. Likewise, in other polishing configurations, a frictional force will be exerted by the polishing surface in the direction of movement of the polishing surface relative to the wafer. A retaining ring is generally used to counter this force and hold the wafer in position. The frictional force of the polishing surface impels the wafer against the retaining ring, which exerts a counterbalancing force to maintain the wafer in position.

The frictional force of the polishing surface and the reactive force exerted by the retaining ring on the wafer may be sufficient to cause the wafer to buckle. This buckling of the wafer may resemble a so-called Euler column familiar to those skilled in the art of material strain analysis. This buckling may result in uneven polishing of the wafer surface, particularly near the edge of the wafer. This problem has been observed in high-speed polishing, particularly for large-diameter, thin wafers.

SUMMARY OF THE INVENTION

Thus, a need has arisen for a wafer polishing machine that addresses the disadvantages and deficiencies of the prior art. In particular, a need has arisen for a wafer polishing machine with a retaining ring that prevents wafer buckling.

Accordingly, an improved wafer polishing machine is disclosed. In one embodiment, the wafer polishing machine has a movable polishing surface and a holder that holds an object, such as a semiconductor wafer, against the movable polishing surface. The holder includes a support structure that supports the object in contact with the polishing surface and an annular retaining ring that retains the object in alignment with the support structure. The retaining ring has a plurality of projections projecting inwardly from its inner circumference. The projections are evenly spaced around the inner circumference of the retaining ring. In one embodiment, the projections on the retaining ring define a circle with a diameter no less than the diameter of the object being polished.

In an alternative embodiment, the retaining ring has a circular inner circumference formed from a flexible material. The inner circumference distends to from a continuous arc of contact with the object during polishing.

A technical advantage of one embodiment of the present invention is that the projections on the retaining ring create multiple points of contact between retaining ring and the wafer, thereby distributing the pressure of the retaining ring on the wafer. Another technical advantage of the various embodiments of the present invention is that the multiple points of contact or continuous arc of contact between the retaining ring and the wafer reduce wafer buckling during polishing, thereby improving surface uniformity.

BRIEF DESCRIPTION OF THE DRAWINGS

For a more complete understanding of the present invention and for further features and advantages, reference is now made to the following description taken in conjunction with the accompanying drawings, in which.

DETAILED DESCRIPTION OF THE INVENTION

The preferred embodiments of the present invention and their advantages are best understood by referring to FIGS. 1 through 6 of the drawings. Like numerals are used for like and corresponding parts of the various drawings.

Figure 1A:
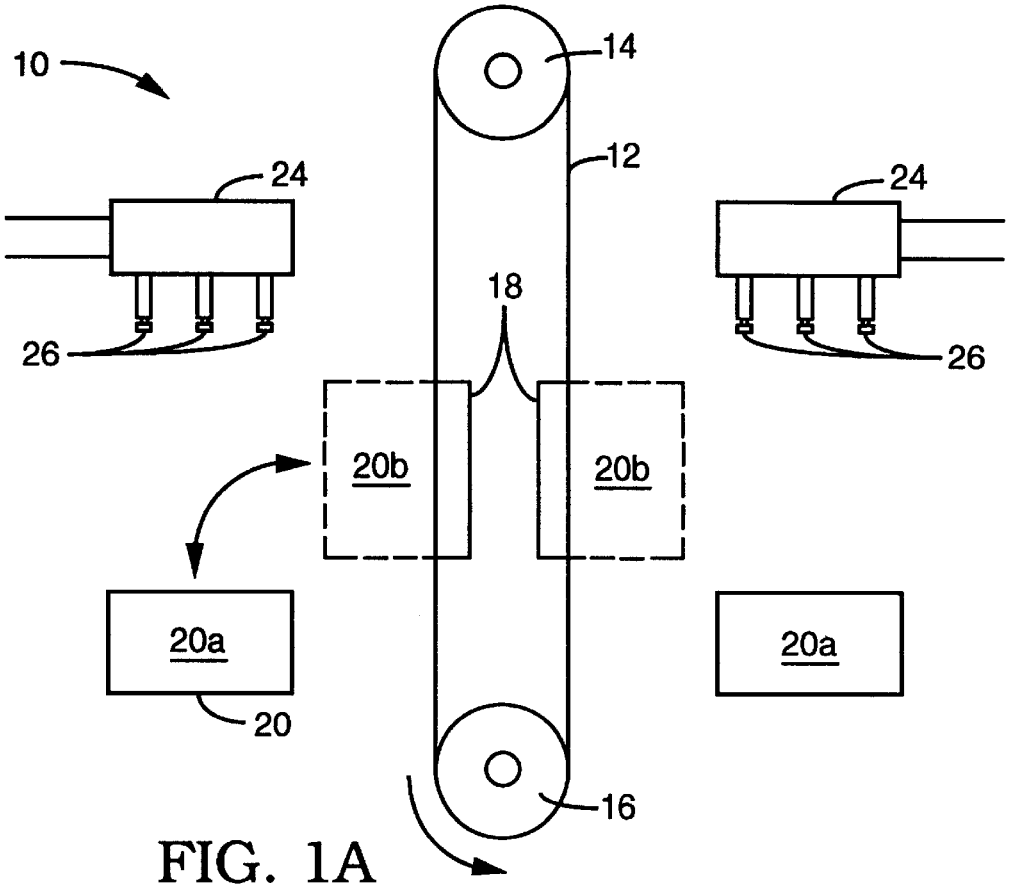
FIGS. 1A and 1B are simplified front and perspective views of a chemical mechanical polishing machine constructed in accordance with the present invention.
Figure 1B:
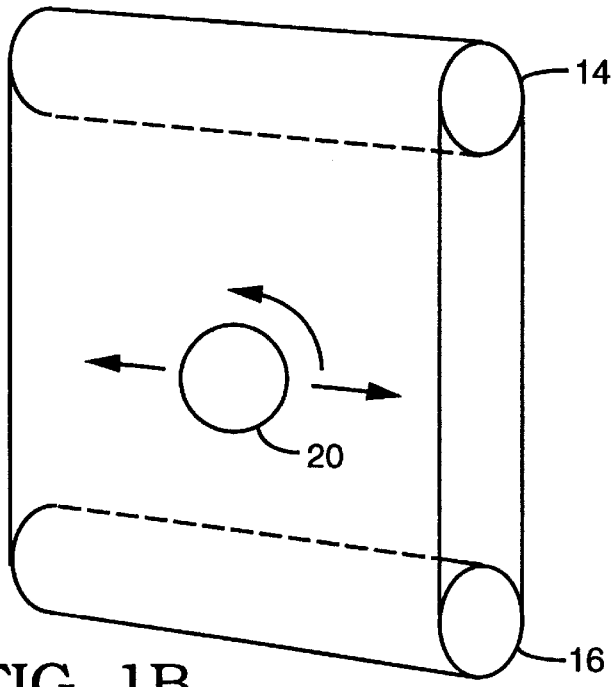

Referring to FIGS. 1A and 1B, simplified front and perspective views of a chemical mechanical polishing (CMP) machine 10 constructed in accordance with the present invention are shown. CMP machine 10 includes a continuous polishing belt 12 which rotates on a pair of rollers 14 and 16. A motor (not shown) drives the bottom roller 16 in a counterclockwise direction, while top roller 14 is free to rotate as polishing belt 12 rotates. Polishing belt 12 may move at a linear rate of up to 1000 feet per minute, or at even greater speeds depending on the object being polished.

A polishing head 20 on each side of CMP machine 10 swivels from a loading and unloading position 20*a* to a polishing position 20*b*. In polishing position 20*b*, polishing head presses a semiconductor wafer (not shown in FIG. 1) against polishing belt 12 as polishing belt 12 rotates. A support head 18 supports polishing belt 12 from the back side, allowing polishing head 20 to press the wafer against polishing belt 12 with a selected pressure, such as from one to five psi.

Polishing head 20 rotates the wafer in a plane parallel to and adjacent to polishing belt 12, preferably at a rate of 10 to 50 revolutions per minute This rotation, in conjunction with the linear motion of polishing belt 12 against the surface of the wafer, results in polishing forces being applied in all directions along the surface of the wafer, and prevents striations from forming on the surface of the wafer.

Polishing head 20 also undergoes lateral oscillation to distribute the wear on polishing belt 12. This oscillation may have a range of, for example, one inch on either side of the center line of polishing belt 12. Polishing head 20 may oscillate at a rate of, for example, up to five cycles per minute. Although lateral oscillation of polishing head 20 is not required to polish wafer 15, lateral oscillation prevents uneven wearing of polishing belt 12, increases the useful life of polishing belt 12 and enhances the uniformity of wafer polishing.

A slurry dispenser (not shown) on each side of CMP machine 10 dispenses a slurry onto polishing belt 12 as polishing belt 12 rotates. The slurry contains abrasive particles which mechanically polish the surface of the wafer when brushed across the surface of the wafer by polishing belt 12.

In loading and unloading position 20*a*, polishing head 20 holds the wafer in a horizontal position. In this position, a wafer gripper 24 may descend and grip the wafer to remove the wafer from polishing head 20. Wafer gripper 24 has a set of pins 26 disposed in a circle that corresponds to the circumference of the wafer. Wafer gripper 24 can move each pin 26 radially inward and outward so as to contract and expand the circle formed by pins 26. Thus, the circle of pins 26 may be expanded before wafer gripper 24 descends to grip the wafer, thus allowing pins 26 to descend past the edge of the wafer. The circle of pins 26 may then be contracted to grip the wafer, allowing the wafer to be lifted from polishing head 20 and moved over a receptacle (not shown). The circle of pins 26 may then be expanded to drop the wafer into the receptacle. In a similar manner, a new wafer may be taken from another receptacle and loaded on polishing head 20 for polishing. Polishing head 20 then swivels into polishing position 20*b* to polish the new wafer.

Further description of an exemplary structure of CMP machine 10 may be found in the U.S. Pat. Application entitled "Modular Wafer Polishing Apparatus And Method," Ser. No. 08/964,930, filed Nov. 5, 1997, now U.S. Pat. No. 5,757,764 isued on Sep. 28, 1999, which is incorporated herein by reference.

Although CMP machine 10 is shown with a vertically oriented polishing surface, it will be understood that the present invention may be advantageously implemented in a horizontal CMP machine, such as those produced by Lain Research in Fremont, Calif.

Figure 2:
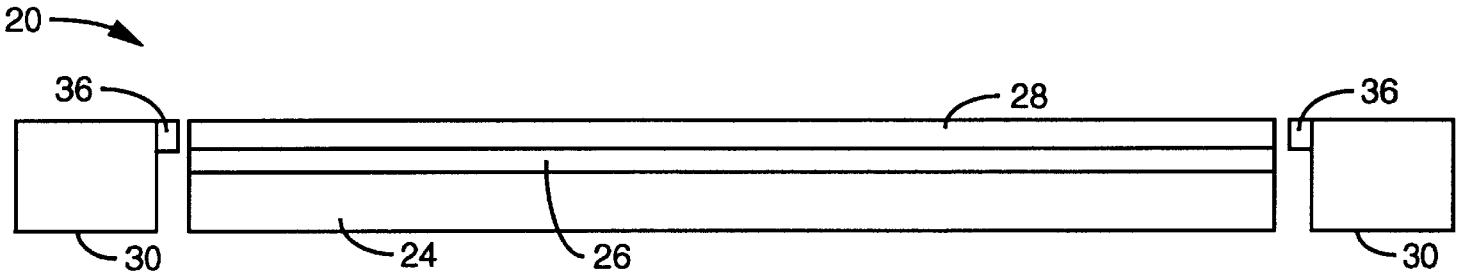
FIG. 2 is a simplified cross section of a polishing head for use in the chemical mechanical polishing machine.

Referring to FIG. 2, a simplified cross section of polishing head 20 is shown. Polishing head 20 includes a support structure 24 and an optional backing film 26 in contact with the back surface of a wafer 28. A retaining ring 30 extends around the outer circumference of wafer 28, holding wafer 28 stationary against the frictional force of polishing belt 12.

Support structure 24 includes a drive plate, bellows, sub-carrier, lift plate and bladder as described in the co-pending U.S. Patent Application entitled "A Polishing Head for a Chemical Mechanical Polishing Apparatus," Ser. No. 09/116,160 now U.S. Pat. No. 6,159,083, filed herewith and incorporated herein by reference. Backing film 26 is unnecessary in this support configuration. Alternatively, support structure 24 may simply comprise a sub-carrier made from a rigid, non-porous material such as stainless steel, in which case backing film 26 is preferably used to cushion and support wafer 28. Support structure 24 may alternatively comprise any other conventional support structure.

Backing film 26 may comprise a porous, soft material such as IC 1000 or SUBA IV manufactured by Rodel, Incorporated in Newark, Del. Backing film 26 may be attached to support structure 24 by double-sided adhesive tape (not shown).

Retaining ring 30, according to one aspect of the present invention, has projections 36 extending inwardly from its inner circumference. Projections 36, which will be described more fully below, contact wafer 28 to hold wafer 28 stationary against the frictional force of polishing belt 12. Projections 36 are illustrated as having a thickness less than the thickness of the body of retaining ring 30. However, projections 36 may be as thick as the body of retaining ring 30.

Figure 3:
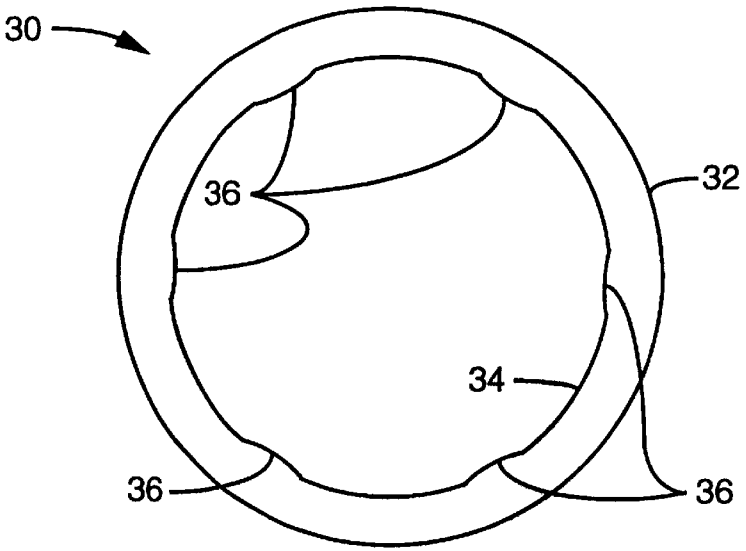
FIG. 3 is a front view of a retaining ring constructed in accordance with one aspect of the present invention.

Referring to FIG. 3, a front view of retaining ring 30 is shown. Retaining ring 30 may be made of a rigid polymer such as Techtron PPS (polyphenylene sulfide), available from E. Jordan Brookes Company in Fremont, Calif., or polyethylene terephthalate (PET). Retaining ring 30 has an outer circumference 32 and an inner circumference 34. For polishing a 200±0.2 mm diameter wafer, retaining ring 30 may have an outer circumference 32 with a diameter of, for example, 10.125 inches (257.18 mm). Inner circumference 34 may have a diameter of, for example, 8.10 inches (205.74 mm).

Along inner circumference 34 is a series of projections 36 projecting radially inward from inner circumference 34. Projections 36 are evenly spaced around inner circumference 34, separated by intervals of 60°, for a total of six projections 36. The tips of projections 36 form a circle with a diameter of, for example, approximately 7.89 inches (200.41 mm), which is slightly larger than the largest diameter wafer to be held by retaining ring 30.

The tips of projections 36 are the only points of contact between retaining ring 30 and wafer 28. During polishing, retaining ring 30 and wafer 28 rotate as previously described, while friction with polishing belt 12 forces wafer 28 to one side of retaining ring 30. Thus, the edge of wafer 28 is in contact with two adjacent projections 36 at most times during polishing. Wafer 28 is in contact with only one projection 36 for brief periods when a projection is approximately aligned with the center of wafer 28 in the direction of the polishing force exerted by polishing belt 12.

Wafer 28 is therefore held in place at most times by retaining ring 30 as a result of force applied at two contact points separated by 60° along the edge of wafer 28. With the frictional force of polishing distributed between two contact points, the buckling of wafer 28 due to the polishing force is significantly reduced. The degree of wafer surface uniformity attainable through polishing is correspondingly increased. In particular, since wafer buckling primarily occurs near the edge of the wafer in typical CMP machines, the surface uniformity near the edge of wafer 28 is increased by the present invention.

Figure 4:
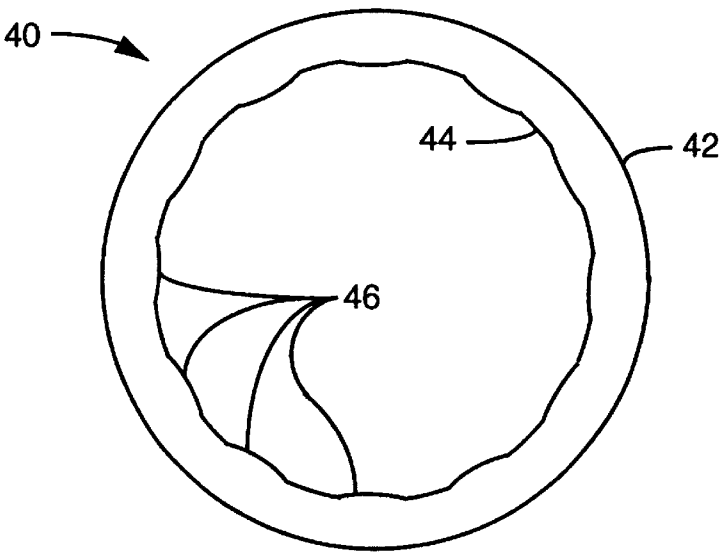
FIG. 4 is a front view of an alternative retaining ring constructed in accordance with one aspect of the present invention.

Referring to FIG. 4, a front view of an alternative retaining ring 40 is shown. Like retaining ring 30, retaining ring 40 may be made of a rigid polymer such as PPS or PET. Retaining ring 40 has an outer circumference 42 and an inner circumference 44. For polishing a 200±0.2 mm diameter wafer, retaining ring 40 may have the same inner and outer circumference measurements as retaining ring 30.

Along inner circumference 44 is a series of projections 46 projecting radially inward from inner circumference 44. Projections 46 are evenly spaced around inner circumference 44, separated by intervals of 30°, for a total of twelve projections 46. The tips of projections 46 form a circle with a diameter of, for example, approximately 7.89 inches (200.41 mm).

As with retaining ring 30, the tips of projections 46 are the only points of contact between retaining ring 40 and wafer 28. During polishing, retaining ring 40 and wafer 28 rotate while friction with polishing belt 12 forces wafer 28 to one side of retaining ring 40. Thus, the edge of wafer 28 is at most times in contact with two adjacent projections 46 at most times during polishing. Wafer 28 is therefore held in place by retaining ring 40 at most times as a result of force applied at two contact points separated by 30° along the edge of wafer 28.

The 30° contact point separation offered by retaining ring 40 has been determined to be less beneficial with regard to surface uniformity than the 60° separation offered by retaining ring 30. However, both retaining rings 30 and 40 offer significant improvements in wafer surface uniformity over that attainable by polishing with a smooth, rigid, circular retaining ring.

Figure 5A:
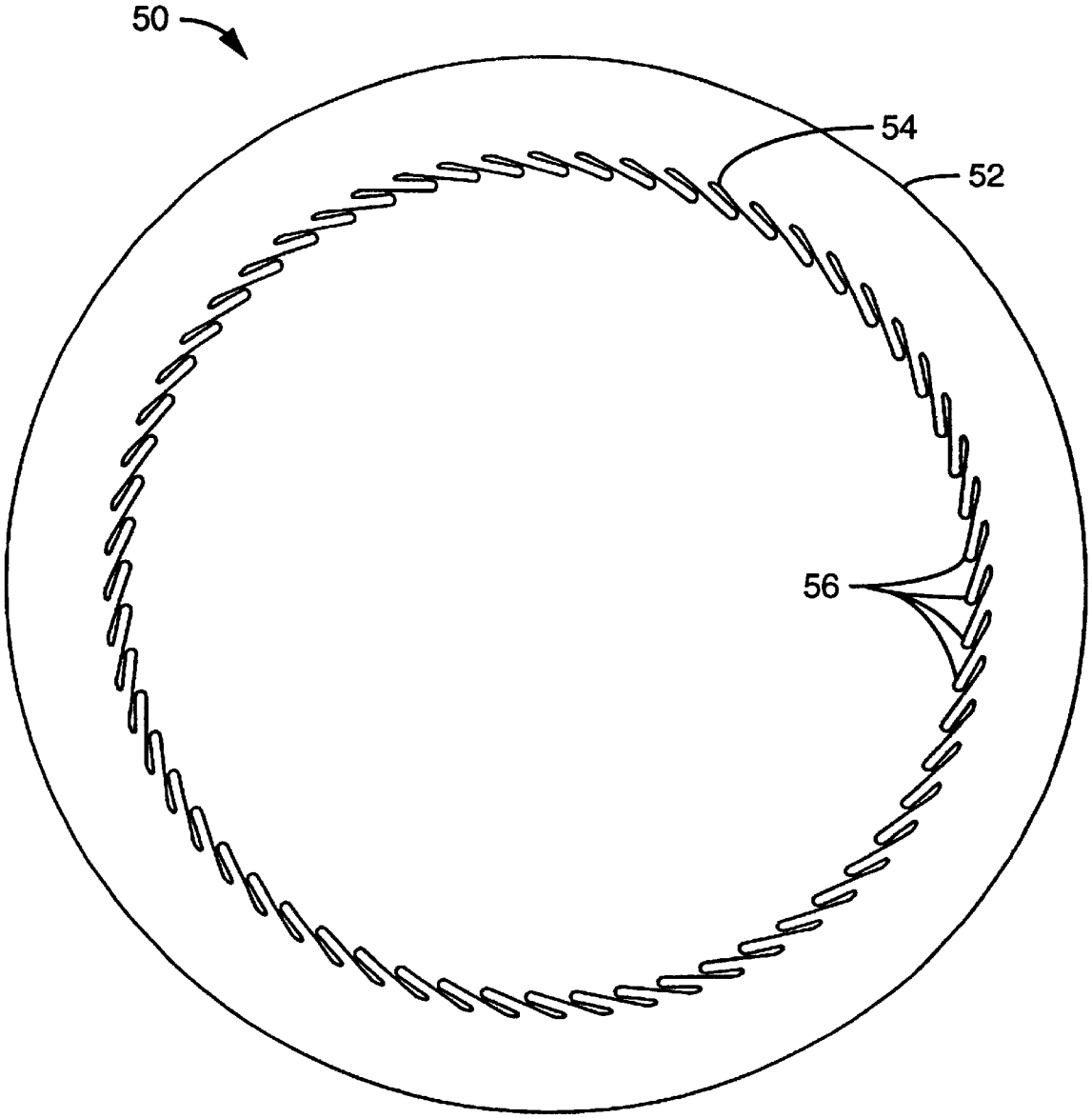
FIGS. 5A and 5B are front and perspective views of another alternative retaining ring constructed in accordance with one aspect of the present invention.
Figure 5B:
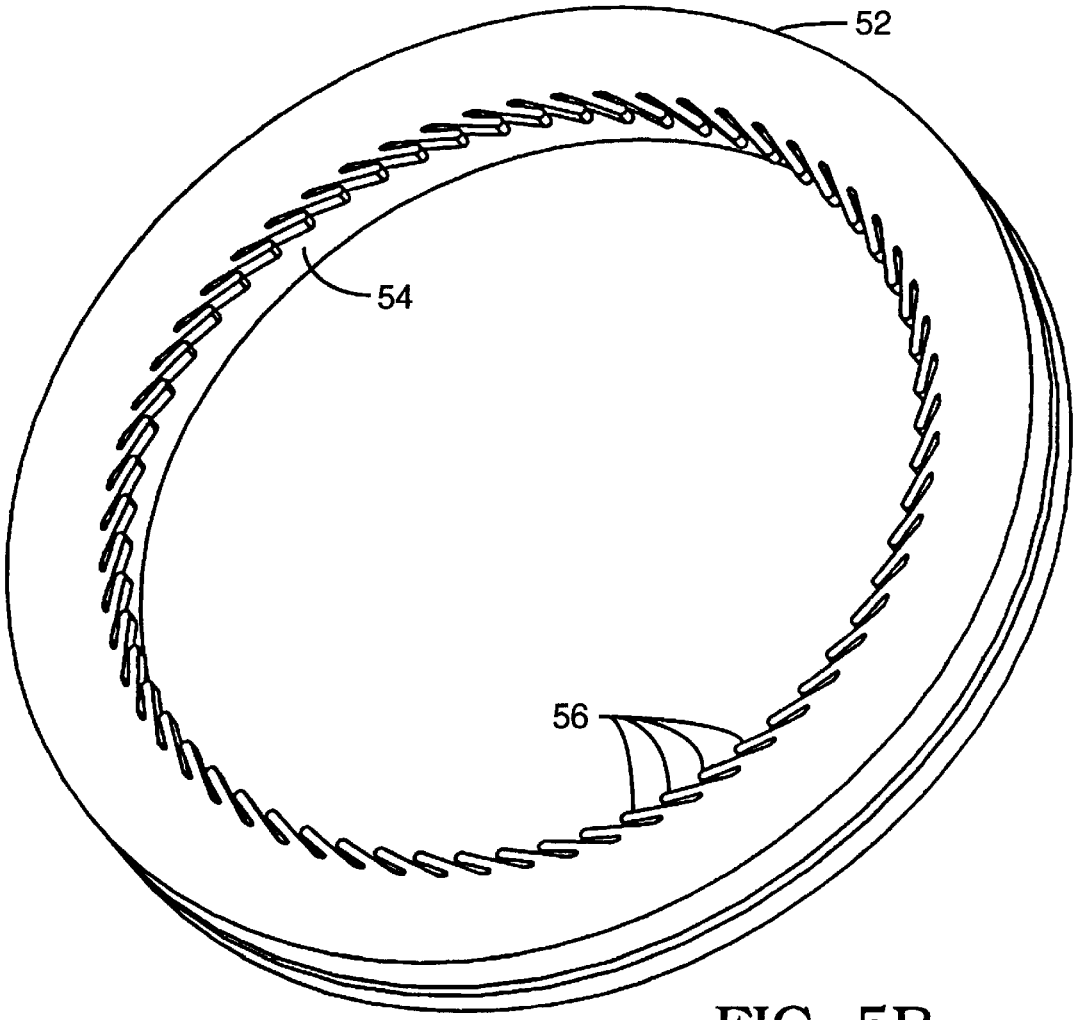

Referring to FIGS. 5A and 5B, front and perspective views of another alternative retaining ring 50 are shown. Like retaining rings 30 and 40, retaining ring 50 may be made of a rigid polymer such as PPS or PET. Retaining ring 50 has an outer circumference 52 and an inner circumference 54. For polishing a 200±0.2 mm diameter wafer, retaining ring 50 may have an outer circumference 52 with a diameter of, for example, 10.2 inches (259.08 mm). Inner circumference 54 may have a diameter of, for example, 8.37 inches (212.60 mm).

Along inner circumference 54 is a series of projections 56 projecting radially inward and diagonally in a clockwise direction. In this example, projections 56 are evenly spaced around inner circumference 54 and separated by intervals of 6°, for a total of 60 projections 56. The tips of projections 56 form a circle with a diameter of, for example, approximately 7.89 inches (200.41 mm).

Unlike retaining rings 30 and 40, retaining ring 50 has flexible projections 56 that provide multiple points of contact for wafer 28. In one embodiment, each projection 56 has a length of 0.35 inches, a width (measured in a radial direction with respect to retaining ring 50) of 0.1 inches, and a thickness (measured in an axial direction with respect to retaining ring 50) of 0.175 inches.

Because projections 56 are relatively long and thin, each projection is capable of bending outward toward inner circumference 54 when a load such as wafer 28 is applied. The amount of deflection (Δ) is approximated by the following equation:

$$\Delta = PL^2/3EI$$

in which P is the load applied to the projection 56, L is the length of the projection 56, E is a material property of the projection 56, and I is the moment of inertia of the projection 56.

As illustrated in FIGS. 5A and 5B, each projection 56 overlaps the base of an adjacent projection 56. Thus, the deflection of one projection 56 may cause the deflection of adjacent projections 56 in a domino-like effect. This effect, along with the close proximity of projections 56 to each other, creates a flexible cushion for wafer 28, with many points of contact along a broad arc of the perimeter of wafer 28. The dimensions and material properties of projections 56 are preferably selected to provide support for wafer 28 along a 60° arc, so as to minimize the buckling of wafer 28 caused by friction with polishing belt 12.

Figure 6:
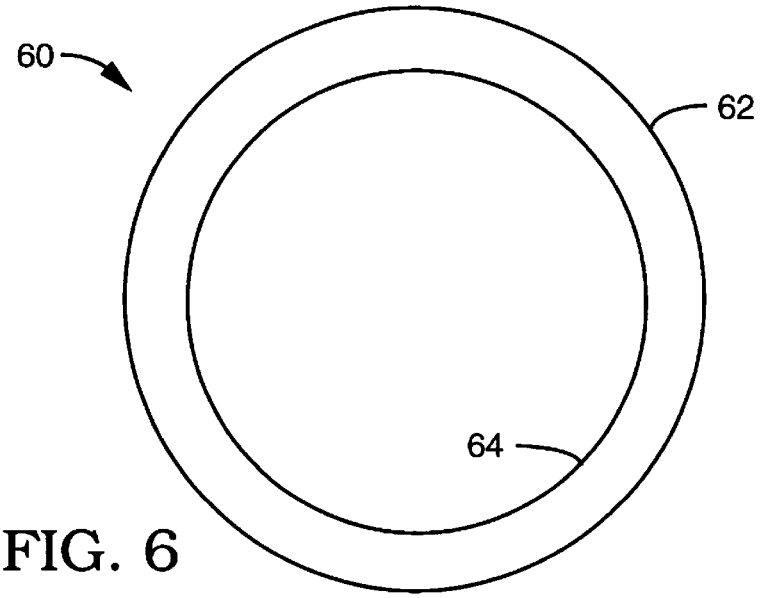
FIG. 6 is a front view of yet another alternative retaining ring constructed in accordance with one aspect of the present invention.

Referring to FIG. 6, a front view of yet another alternative retaining ring 60 is shown. Retaining ring 60 has an outer circumference 62 with a diameter of, for example, 10.2 inches, and an inner circumference 64 with a diameter of, for example, 7.89 inches. Retaining ring 60, unlike the retaining rings previously described, has a smooth inner circumference 64 with no projections thereon. The body of retaining ring 60 is made of a rigid polymer such as PPS or PET. Inner circumference 64 is constructed of a flexible material such as Viton available from DuPont Dow Elastomers in Wilmington, Del., or the terpolymer elastomer of ethylene-propylene diene monomer (commonly termed EPDM). The thickness of inner circumference 64 is typically less than the thickness of the body of retaining ring 60. However, inner circumference 64 may be as thick as the body of retaining ring 60. During polishing, when wafer 28 is pressed against a portion of retaining ring 60, inner circumference 64 distends to provide a continuous arc of contact between retaining ring 60 and wafer 28. As with retaining ring 50, the dimensions and material properties of retaining ring 60 are preferably selected to provide support for wafer 28 along an arc of at least 30°, preferably approximately 60°, so as to minimize the buckling of wafer 28 caused by friction with polishing belt 12.

Although CMP machine 10 and retaining rings 30, 40, 50 and 60 have been described with reference to semiconductor wafer polishing, it will be understood that retaining rings 30, 40, 50 and 60 may be advantageously implemented in other polishing or lapping applications, such as the polishing or lapping of disks and thin film heads for hard disk drives. Furthermore, although a vertical continuous belt CMP machine 10 has been used to illustrate the present invention, it will be understood that the invention may be advantageously implemented in other conventional CMP machine designs, such as those with horizontal belt, disk, or planetary polishing surfaces.

Thus, although the present invention and its advantages have been described in detail, it should be understood that various changes, substitutions, and alterations can be made therein without departing from the spirit and scope of the invention as defined by the appended claims.

What is claimed is:

1. A retaining ring for retaining an object during polishing of a surface of the object, comprising:

an circular inner circumference;

a plurality of projections attached to and projecting inwardly from the inner circumference of the retaining ring, the projections having tips defining a circle, the circle having a diameter greater than a diameter of the object, the projections being situated such that the object contacts fewer than all of the projections during polishing.

2. The retaining ring of claim 1, wherein the projections are evenly spaced around the inner circumference of the retaining ring.

3. A retaining ring for retaining a disk-shaped object during polishing of a surface of the object, comprising a circular inner circumference formed from a flexible material, the inner circumference being operable to distend in response to lateral force exerted during polishing to form a continuous arc of contact with the object during polishing, the arc of contact covering at least approximately 30° and less than 360° of a circumference of the object.

4. The retaining ring of claim 1, wherein the projections are situated at approximately 60° intervals around the inner circumference of the retaining ring.

5. The retaining ring of claim 1, wherein the projections are situated at approximately 30° intervals around the inner circumference of the retaining ring.

6. The retaining ring of claim 1, wherein each projection comprises a flexible member having a first end attached to the inner circumference of the retaining ring and a second end extending radially inward at an angle relative to a radius of the retaining ring.

7. The retaining ring of claim 1, further comprising an annular body having a first thickness, wherein each projection has a second thickness, the second thickness being less than the first thickness.

8. A polishing machine for polishing a surface of an object, the polishing machine comprising:

a polishing surface; and a holder operable to hold the object against the polishing surface, the holder having a support structure operable to support the object in contact with the polishing surface, the holder further having an annular retaining ring operable to retain the object in alignment with the support structure, the retaining ring having a plurality of projections projecting inwardly from an inner circumference of the retaining ring, the projections having tips defining a circle, the circle having a diameter greater than a diameter of the object, the projections being situated such that the object contacts fewer than all of the projections during polishing.

9. A wafer holder operable to hold a wafer against a polishing surface during polishing of the wafer, the wafer holder comprising:

a support structure in contact with the back side of the wafer, the support structure being operable to support the wafer against the polishing surface; and an annular retaining ring operable to retain the wafer in alignment with the support structure, the retaining ring having a plurality of projections projecting inwardly from an inner circumference of the retaining ring, the projections having tips defining a circle, the circle having a diameter greater than a diameter of the object, the projections being situated such that the object contacts fewer than all of the projections during polishing.

10. The wafer holder of claim 9, wherein each projection comprises a flexible member having a first end attached to the inner circumference of the retaining ring and a second end extending radially inward at an angle relative to a radius of the retaining ring.

11. The wafer holder of claim 9, wherein the projections of the retaining ring are evenly spaced around the inner circumference of the retaining ring.

12. The wafer holder of claim 9, wherein the projections of the retaining ring are situated at approximately 60° intervals around the inner circumference of the retaining ring.

13. The polishing machine of claim 8, wherein each projection comprises a flexible member having a first end attached to the inner circumference of the retaining ring and a second end extending radially inward at an angle relative to a radius of the retaining ring.

14. The polishing machine of claim 8, wherein each projection comprises a first end attached to the inner circumference of the retaining ring and a second end extending radially inward and across a radius of the retaining ring defined by the first end of an adjacent projection.

15. The polishing machine of claim 8, wherein the polishing surface comprises a continuous belt mounted on a plurality of rollers.

16. The polishing machine of claim 8, further comprising a slurry dispenser operable to dispense a slurry on the movable polishing surface.

17. The polishing machine of claim 8, wherein the projections of the retaining ring are evenly spaced around the inner circumference of the retaining ring.

18. The polishing machine of claim 8, wherein the projections of the retaining ring are situated at approximately 60° intervals around the inner circumference of the retaining ring.

* * * * *

UNITED STATES PATENT AND TRADEMARK OFFICE

CERTIFICATE OF CORRECTION

PATENT NO. : 6,267,655 B1 
DATED : July 31, 2001
INVENTOR(S) : David E. Weldon et al.

It is certified that error appears in the above-identified patent and that said Letters Patent is hereby corrected as shown below:

Column 3,
Line 37, please delete "isued" and insert -- issued --; and
Line 42, please delete "Lain" and insert -- Lam --.

Signed and Sealed this

Twenty-eighth Day of January, 2003

JAMES E. ROGAN
*Director of the United States Patent and Trademark Office*